US009151165B2

(12) United States Patent
Donnell et al.

(10) Patent No.: US 9,151,165 B2
(45) Date of Patent: Oct. 6, 2015

(54) REVERSIBLE BLADE DAMPER

(71) Applicant: United Technologies Corporation, Hartford, CT (US)

(72) Inventors: Brandon S. Donnell, Hartford, CT (US); Yafet Girma, Hartford, CT (US); Gina C. O'Dell, Pawleys Island, SC (US)

(73) Assignee: United Technologies Corporation, Hartford, CT (US)

( * ) Notice: Subject to any disclaimer, the term of this patent is extended or adjusted under 35 U.S.C. 154(b) by 416 days.

(21) Appl. No.: 13/657,190

(22) Filed: Oct. 22, 2012

(65) Prior Publication Data

US 2014/0112786 A1 Apr. 24, 2014

(51) Int. Cl.

| | |
|---|---|
| ***F01D 5/26*** | (2006.01) |
| ***F01D 5/22*** | (2006.01) |
| ***F01D 11/00*** | (2006.01) |

(52) U.S. Cl.

CPC .. *F01D 5/22* (2013.01); *F01D 5/26* (2013.01); *F01D 11/005* (2013.01); *F01D 11/008* (2013.01)

(58) Field of Classification Search

CPC ..... F01D 5/22; F01D 5/225; F01D 5/26; F01D 11/006; F01D 11/008; F01D 11/005; F01D 25/06; F05D 2260/96

USPC ..... 415/145, 190, 193 A, 248, 500; 416/145, 190, 193 A, 248, 500

See application file for complete search history.

(56) References Cited

U.S. PATENT DOCUMENTS

| | | | | |
|---|---|---|---|---|
| 4,473,337 | A | 9/1984 | Leonardi et al. | |
| 4,872,810 | A | 10/1989 | Brown et al. | |
| 5,228,835 | A * | 7/1993 | Chlus | 416/500 |
| 5,785,499 | A | 7/1998 | Houston et al. | |
| 6,273,683 | B1 | 8/2001 | Zagar et al. | |
| 6,315,298 | B1 | 11/2001 | Kildea et al. | |
| 6,471,484 | B1 | 10/2002 | Crall | |
| 6,475,935 | B1 | 11/2002 | Ishizaki et al. | |
| 6,905,312 | B2 | 6/2005 | Bourgy et al. | |
| 7,121,800 | B2 | 10/2006 | Beattie | |
| 7,168,914 | B2 | 1/2007 | Shiozaki et al. | |
| 8,011,892 | B2 | 9/2011 | Ramlogan et al. | |
| 2006/0056974 | A1 | 3/2006 | Beattie | |
| 2009/0004013 | A1 | 1/2009 | Ramlogan et al. | |

OTHER PUBLICATIONS

International Search Report and Written Opinion for International Application No. PCT/US2013/065202 mailed on Jul. 24, 2014.

International Preliminary Report on Patentability for International Application No. PCT/US2013/065202 mailed May 7, 2015.

* cited by examiner

*Primary Examiner* — Christopher Verdier

(74) *Attorney, Agent, or Firm* — Carlson, Gaskey & Olds, PC

(57) ABSTRACT

A damper body extends between an axial first end, an opposing axial second end, a first lateral side, and an opposing second lateral side. A first pair of lugs are disposed at the first axial end and a second pair of lugs are disposed at the second axial end. In the first lug pair, a lug has an axially outermost foot which extends laterally beyond a lateral wall. The second lug pair has a lug with an axial outermost point with a foot extending laterally beyond a lateral wall. The foot on the first axial end and the foot on the second axial end are on opposed lateral sides.

8 Claims, 6 Drawing Sheets

REVERSIBLE BLADE DAMPER

STATEMENT REGARDING FEDERALLY SPONSORED RESEARCH OR DEVELOPMENT

This invention was made with government support under Contract No. N00019-02-3003 awarded by the United States Air Force. The Government has certain rights in this invention.

BACKGROUND OF THE INVENTION

This application relates generally to a turbine blade platform seal and damper assembly and specifically to a reversible blade damper within the assembly.

Conventional gas turbine engines include a turbine assembly that has a plurality of turbine blades attached about a circumference of a turbine rotor. Each of the turbine blades is spaced a distance apart from adjacent turbine blades to accommodate movement and expansion during operation. The blades typically include an attachment that attaches to the rotor, a platform that extends between pressure and suction sides, and an airfoil that extends radially outwardly from the platform. There is a gap between adjacent platforms.

A blade platform seal is utilized to span the gap, as relatively cool air for cooling the blade is radially inward of the platform, and the hot products of combustion are radially outward of the platform. The blade platform seal has typically also been associated with a damper which dissipates potential vibrations. The damper fits within pockets in the sides of the two adjacent blades.

The damper has four lugs extending in an axial direction away from a main damper body. Three of the lugs have extended generally perpendicular to the sides of the damper, and a forth lug has a circumferentially outwardly extending foot. The foot is received within a pocket in one side of one of the blades, and assures that the damper will not come out of its desired location between the two adjacent blades. In addition, a shoulder provides a radial reaction surface with a post on the blade.

In the past, the dampers may sometimes have been assembled relative to a seal 180° out of their proper orientation. When this has occurred, the circumferentially outwardly extending foot points toward the opposed blade, which has no need for the foot. The blade pocket which should receive the foot does not, and thus the damper has not always been adequately secured. In addition, the shoulder will be out of position relative to the post on the blade.

FIG. 1A shows a prior art damper 100. In the prior art damper 100, there is a seal slot 400 defined between two shoulders 102. The seal 70 (see FIGS. 1C/D) will be secured between the shoulders 102. A first lug 104 extends generally parallel to the sides 12 of the shoulders 102, as do lugs 110 and 112. These lugs all fit within pocket structure on the adjacent blades, as can be appreciated from the following disclosure. In addition, one lug 106 has a circumferentially outwardly extending foot 108.

There are shoulders 115 on an opposed end of a damper 100 from the foot 108. The shoulders 115 will contact a post on associated blades to provide a radial reaction surface. An axial reaction surface 114 will sit adjacent the posts.

FIG. 1B shows the bottom side of the damper 100. Axial Reaction Surface 114 also extends in a direction away from the seal, which is secured on the opposed side.

FIG. 1C shows an assembled damper 100 and seal 70 with the prior art damper. As shown, the lug 106 has its foot 108 extending in a direction such that the foot 108 will be properly received in a pocket in a blade. The shoulder 115 will be received above a post.

However, the prior art damper has sometimes been inadvertently mounted such that it is rotated by 180° from the position shown in FIG. 1C. This position is shown in FIG. 1D. Now, the circumferentially extending foot 108 points in the opposed direction, and will be spaced axially away from the desired position of FIG. 1C. With this arrangement, the straight lug 112 is received where the foot 108 is intended. The lug 112 will not secure the damper 100 within the blade pocket. In addition, the shoulder 115 is at an improper location, such that there will not be a radial reaction surface.

This is undesirable.

SUMMARY OF THE INVENTION

In a featured embodiment, a damper for use with a turbine seal has a damper body extending along an axial dimension with an axial first end, an opposing axial second end, a first lateral side, and an opposing second lateral side. The damper body has four lugs, including a first pair of lugs disposed at the first axial end and a second pair lugs disposed at the second axial end. A first lug in each lug pair is on the first lateral side of the damper and a second lug in each lug pair is on the second lateral side of the damper. In the first lug pair, the first lug extends to an axially outermost point, which is not laterally beyond a lateral side wall of the first lug. The second lug has an axially outermost foot which extends laterally beyond a lateral wall of the second lug. In the second lug pair, the second lug has an axial outermost point which does not extend laterally beyond a lateral side wall of the second lug. The first lug has an axial outermost point with a foot extending laterally beyond a lateral wall of the first lug. The foot on the first axial end of the damper is on the first lateral side. The foot on the second axial end is on the second lateral side.

In another embodiment according to the previous embodiment, the damper body can be installed on a seal in either of two orientations, and there will still be a foot facing an intended pocket on a gas turbine engine blade which is to receive the damper.

In another embodiment according to any of the previous embodiments, the damper body also has a pair of radial reaction shoulders on the first lateral side, and a pair of radial reaction shoulders on the second lateral side.

In another featured embodiment, a damper for use in a turbine seal comprising has a damper body extending along an axial dimension. The damper body has an axial first end, an opposing axial second end, a first lateral side, and an opposing second lateral side. The damper body has a laterally extending first foot on a first axial end, and on the first lateral side. The damper body has a second foot at the second axial end and on the second lateral side. The first foot is configured to be received in a pocket on a blade when the damper is properly positioned on the blade. The second foot extends laterally outwardly of the blade when the damper is properly positioned.

In another embodiment according to the previous embodiment, there are a pair of radial reaction shoulders on each of the first and second lateral sides.

In another featured embodiment, a turbine assembly has a plurality of circumferentially spaced turbine blades. Each of the turbine blades has an airfoil extending radially outwardly of a platform. The airfoils define a leading edge and extend to a trailing edge, with the trailing edge being generally spaced axially from the edge. There is a suction side and a pressure side for each platform on each of the blades. A seal and damper assembly is positioned circumferentially intermediate a suction side of a first of the blades, and a pressure side of a second of the blades. The seal is received within shoulders on a body of the damper. The damper includes a damper body extending along an axial dimension. The damper body has an axial first end, an opposing axial second end, a first lateral side, and an opposing second lateral side. The damper body has four lugs, including a first pair of lugs disposed at the first axial end and a second pair lugs disposed at the second axial end. A first lug in each lug pair is on the first lateral side of the damper and a second lug in each lug pair is on the second lateral side of the damper. In the first lug pair, the first lug extends to an axially outermost point, which is not laterally beyond a lateral side wall of the first lug. The second lug has an axially outermost foot which extends laterally beyond a lateral wall of the second lug. In the second lug pair, the second lug has an axial outermost point which does not extend laterally beyond a lateral side wall of the second lug. The first lug has an axial outermost point with a foot extending laterally beyond a lateral wall of the first lug. The foot on the first axial end of the damper is on the first lateral side, and the foot on the second axial end is on the second lateral side.

In another embodiment according to the previous embodiment, the damper body can be installed on a seal in either of two orientations. There will still be a foot received in a pocket on one of the first and second blades.

In another embodiment according to any of the previous embodiments, the damper body also has a pair of radial reaction shoulders on the first lateral side, and a pair of radial reaction shoulders on the second lateral side.

In another embodiment according to any of the previous embodiments, both of the first and second blades have a pocket adjacent the leading edge, and a post spaced toward the trailing edge from the leading edge on both of the suction and pressure sides. One of the first and second feet is received in the pocket of one of the first and second blades, with the other of the first and second feet being on an opposed axial side of one of the posts relative to one of the feet.

In another embodiment according to any of the previous embodiments, one of the radial reaction shoulders on each of the first and second lateral sides is positioned radially outwardly of one of the posts on each of the first and second blades, and the other of the radial reaction shoulders on each of the first and second lateral sides is spaced axially from the post.

These and other features of this application will be best understood from the following specification and drawings, the following of which is a brief description.

DETAILED DESCRIPTION

Figure 1B:
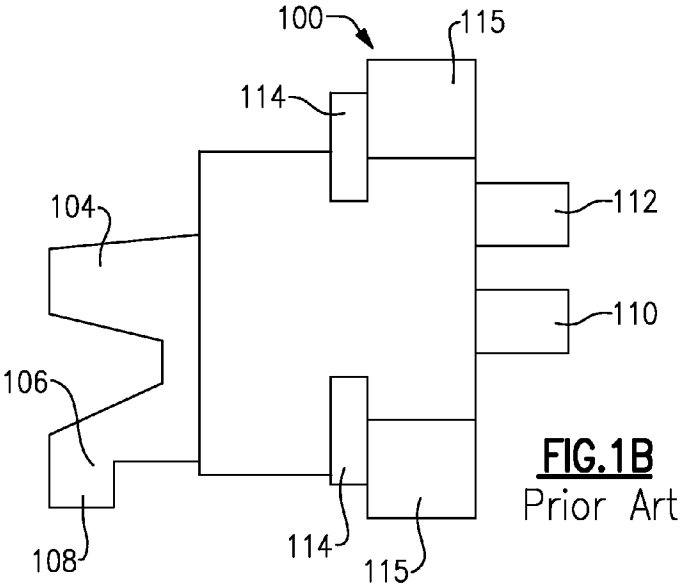
FIG.1B Prior Art
FIG. 1B shows a reverse side of the prior art damper.
Figure 1D:
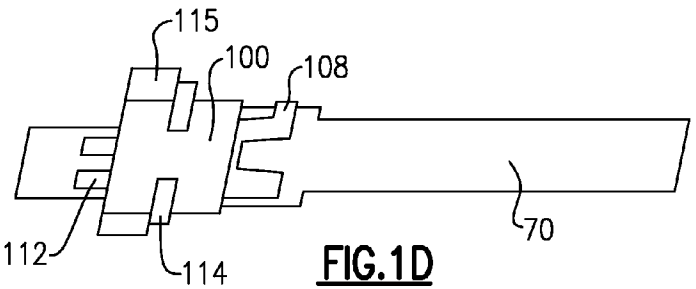
FIG.1D Prior Art
FIG. 1D shows an improperly installed prior art damper.
Figure 1A:
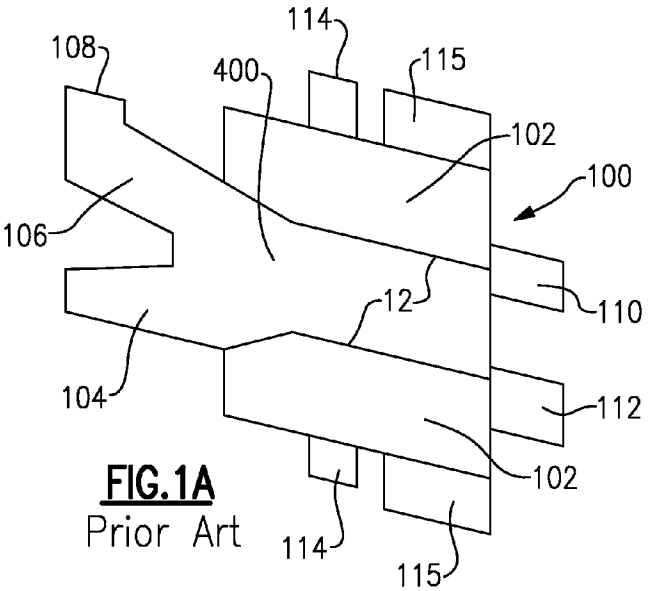
FIG.1A Prior Art
FIG. 1A shows a prior art damper.
Figure 1C:
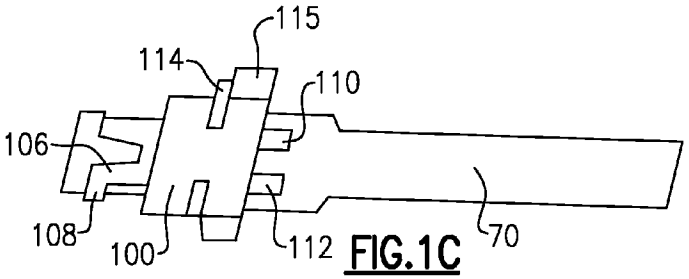
FIG.1C Prior Art
FIG. 1C shows a properly installed prior art damper.
Figure 2:
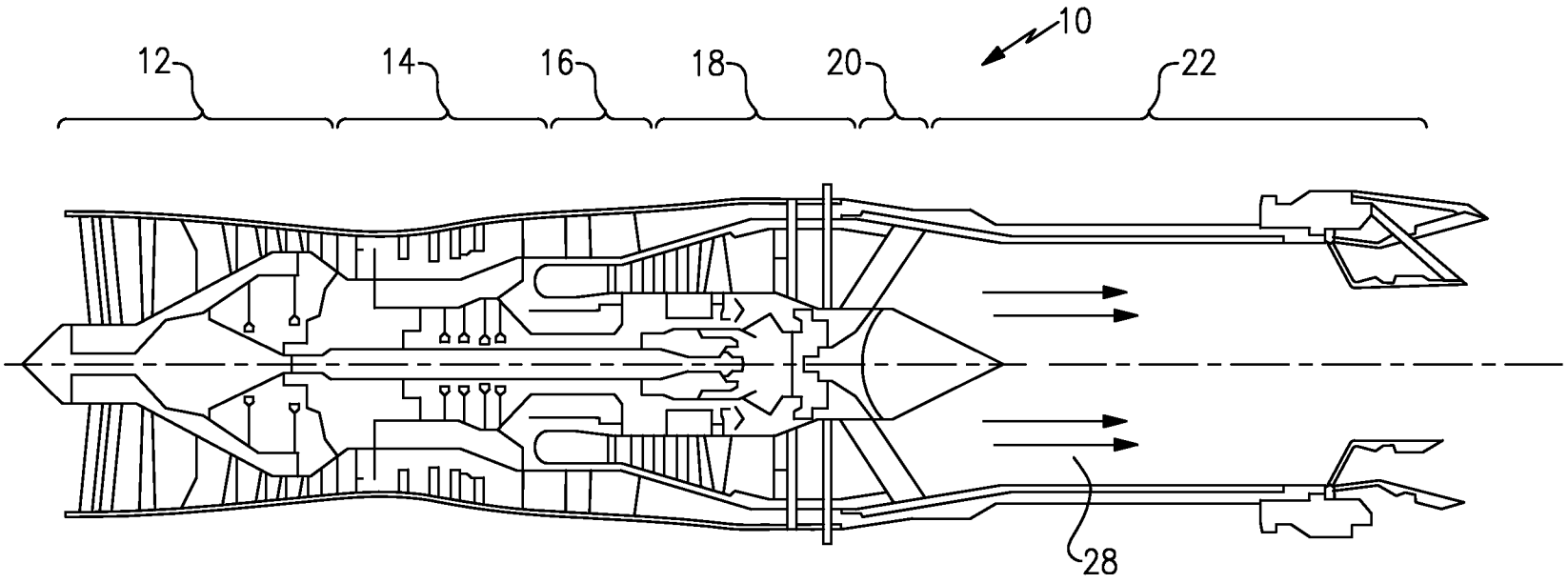
FIG. 2 schematically shows an engine.

Referring to FIG. 2, a gas turbine engine 10 includes a fan section 12, a compressor section 14, a combustor section 16, and a turbine section 18. Air entering into the fan section 12 is initially compressed and fed to the compressor section 14. In the compressor section 14, the incoming air from the fan section 12 is further compressed and communicated to the combustor section 16. In the combustor section 16, the compressed air is mixed with gas and ignited to generate a hot exhaust stream 28. The hot exhaust stream 28 is expanded through the turbine section 18 to drive the fan section 12 and the compressor section 14. In this example, the gas turbine engine 10 includes an augmenter section 20 where additional fuel can be mixed with the exhaust gasses 28 and ignited to generate additional thrust. The exhaust gasses 28 flow from the turbine section 18 and the augmenter section 20 through an exhaust liner assembly 22.

Figure 3A:
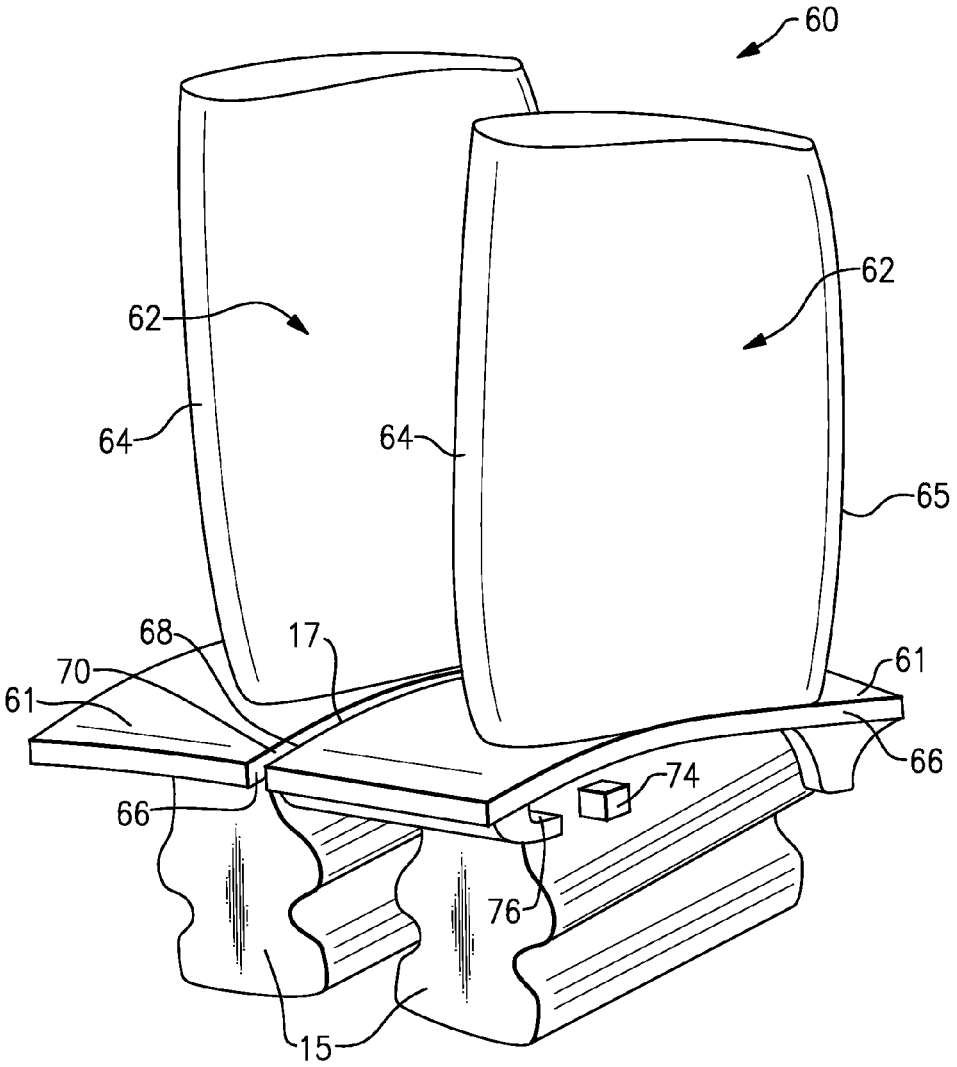
FIG. 3A is a perspective view of adjacent turbine blade assemblies

Referring to FIG. 3A, a turbine section 18 includes a plurality of adjacent turbine blades 60. Each of the turbine blades 60 includes an attachment 15 that is fit into a radial slot of a turbine rotor (not shown). As shown, a platform 61 is positioned radially inwardly of an airfoil 62. The airfoil 62 extends from a leading edge 64 to a trailing edge 65. The platform has a suction side 68 and a pressure side 66. There is a gap 17 between the pressure side 66 of one blade 60, and the suction side 68 of the adjacent blade 60.

Figure 3B:
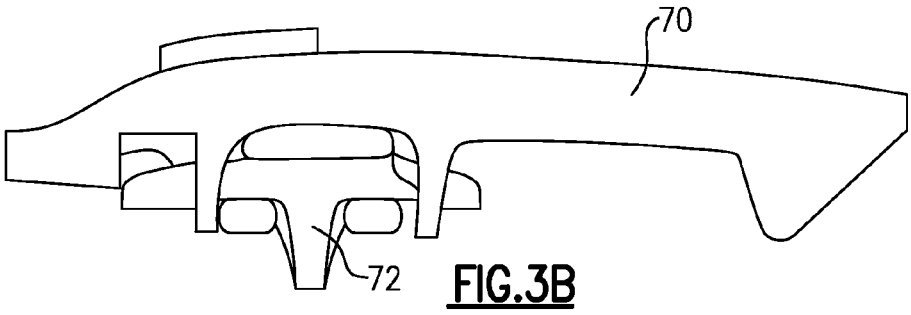
FIG. 3B shows a damper and platform seal assembly.

A seal 70 and damper 72, as shown in FIG. 3B, span the gap 17.

Figure 4A:
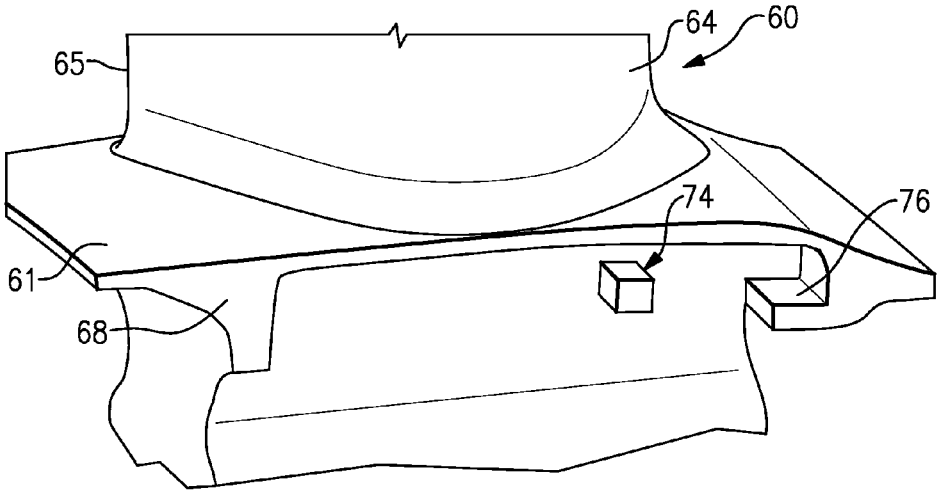
FIG. 4A shows a suction side of a turbine blade.
Figure 4B:
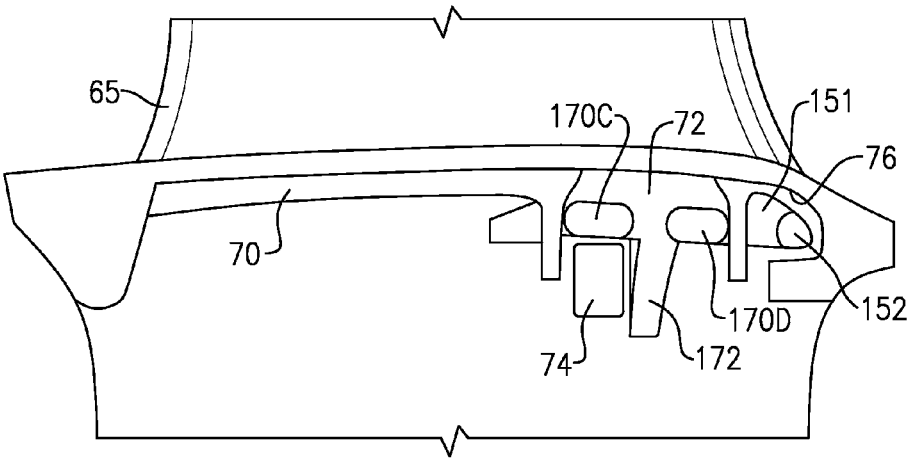
FIG. 4B shows how a damper fits within the FIG. 4A suction side.

As shown in FIGS. 4A and 4B, the seal 70 and damper 72 are received on blade 60, just beneath the platform 61. As shown, there is a post 74 that provides a reaction surface for structure on the damper 72. In addition, there is a pocket 76 beneath the leading edge 64 of the airfoil, which will also receive structure from the damper 72, to secure the damper 72 in the pocket.

The post 74 is positioned towards the trailing edge 65 from the pocket 76. As shown in FIG. 4B, the damper 72 will be received adjacent to this structure. As can be appreciated in this figure, the damper has a lug 151 having a circumferentially outwardly extending foot 152 extending away from the pocket 76. This will be explained in greater detail below.

As can be seen, an axial reaction surface 172 is positioned axially adjacent to post 74. A shoulder 170C sits atop the post 74, or radially outwardly, to provide a radial reaction surface. A shoulder 170D is spaced from post 74, and provides no function in this position.

Figure 5A:
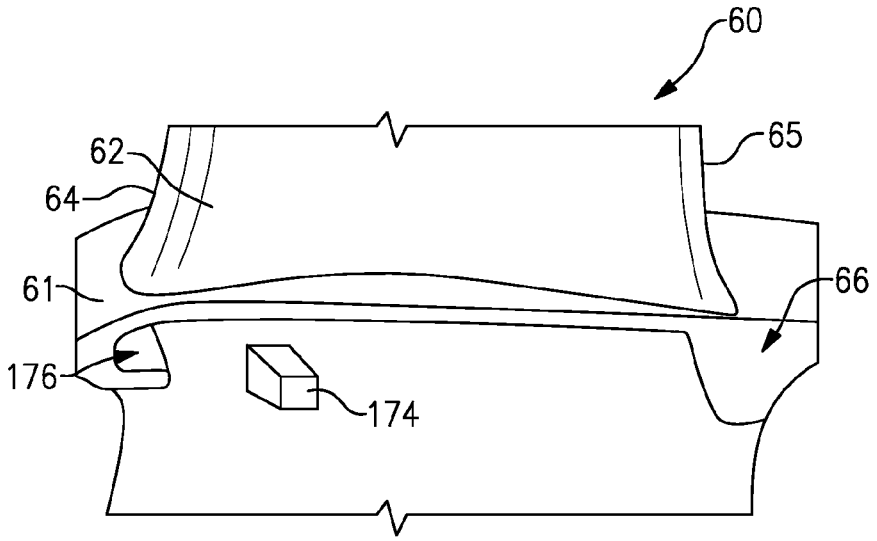
FIG. 5A shows a pressure side of a turbine blade.
Figure 5B:
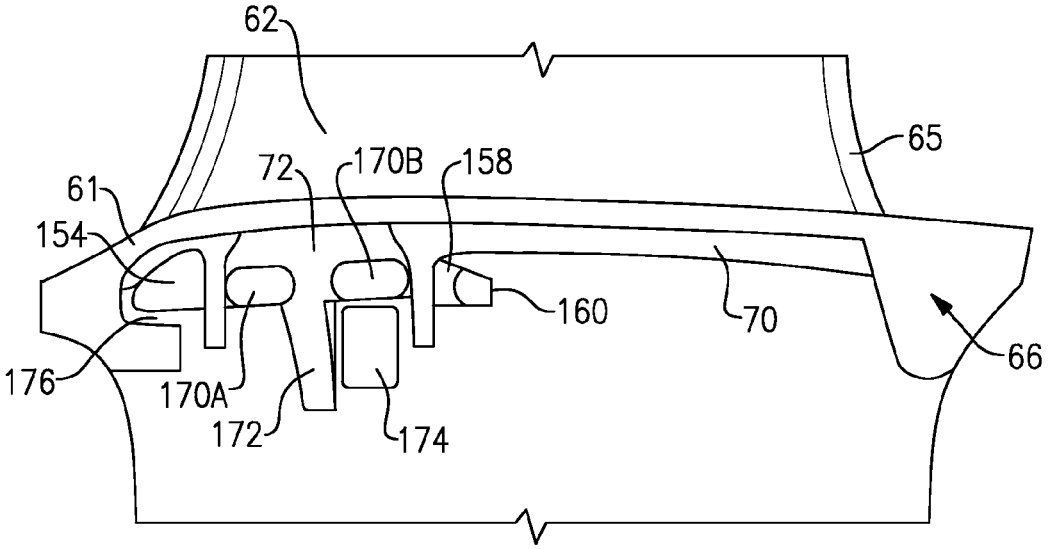
FIG. 5B shows how a damper fits within the FIG. 5A pressure side.

FIG. 5A shows the pressure side 66 of the blade 60. Another pocket 176 is positioned toward the leading edge 64 and another post 174 is positioned in a direction toward the trailing edge 65 from the pocket 176. In FIG. 5B, the damper 72 and seal 70 are shown mounted to blade 60. The foot 152 extends circumferentially away from the suction wall as shown in FIG. 4B, and extends into the pocket 176 to assist in securing the damper 72.

In FIG. 5B lug 158 is shown with a circumferentially outwardly extending foot 160 extending away from this pressure side 66. As can be appreciated from this Figure, the foot 160 would not contact any structure on the blade 60. The purpose of this feature will be described below.

As can be seen, an axial reaction surface 172 is positioned axially adjacent to post 174, and the shoulder 170B sits atop the post 174, or radially outwardly, to provide a radial reaction surface. The shoulder 170A performs no function in this position.

Figure 6A:
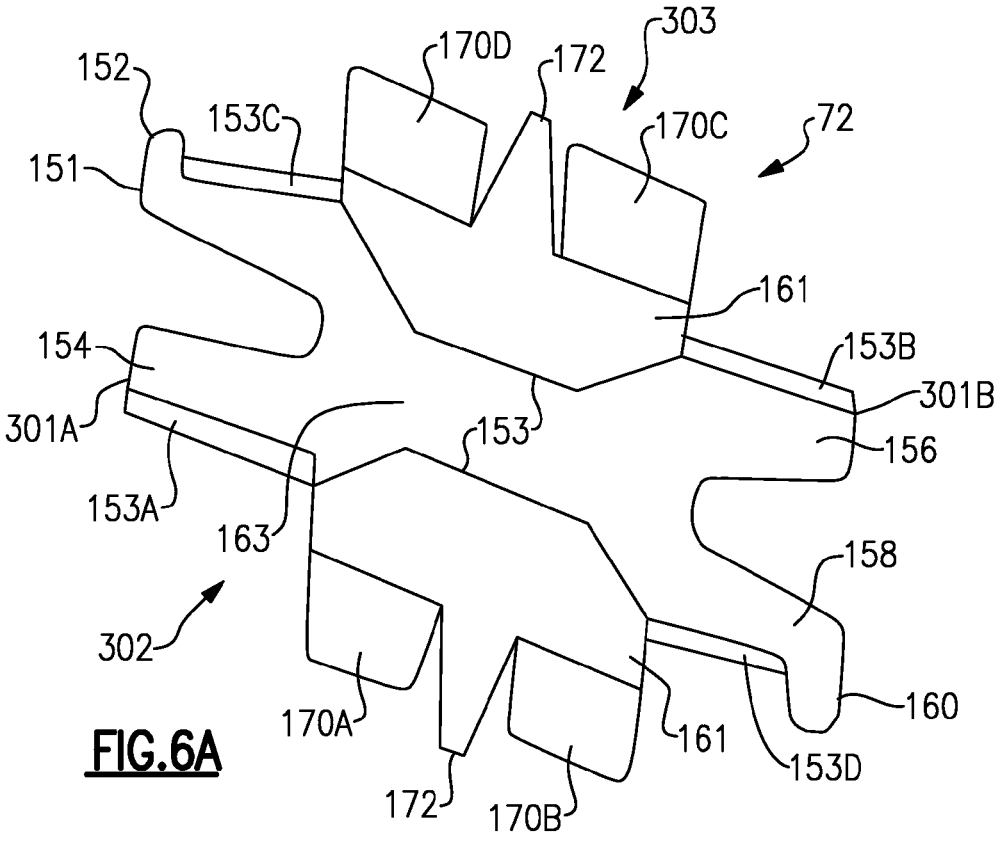
FIG. 6A shows a new damper.
Figure 6B:
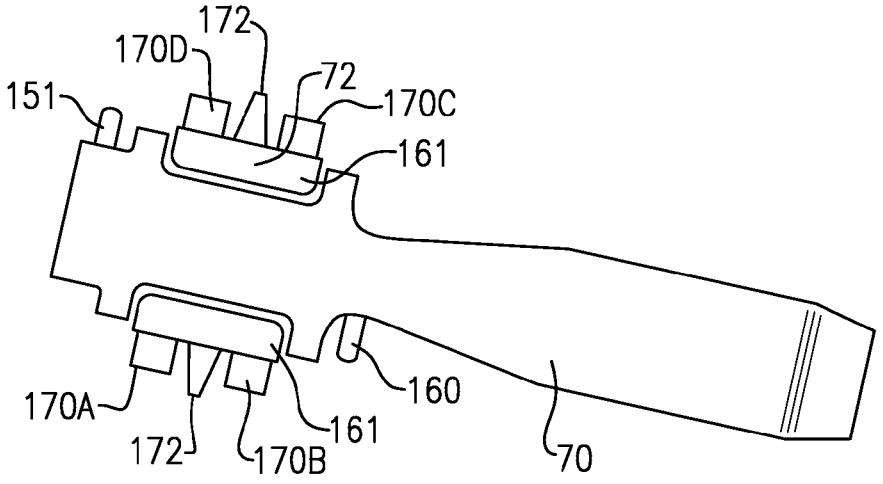
FIG. 6B shows the new damper mounted on a seal.

FIG. 6A shows the previously identified improved damper 72. Again, there are shoulders 161 to secure the seal 70 in a channel 163 underneath shoulders 161. Lugs 154 and 156 extend generally parallel to the sides 153 defined by the shoulders 161. Stated another way, the lugs 154 and 156 have axially extending sides 153A and 153B, respectively, which extend along an axis of the engine. Ends 301A and B of the lugs 154 and 156, respectively, do not extend circumferentially outwardly of those sides 153A and 153B.

As can be appreciated, a lug 151 has a circumferentially outwardly extending foot 152 which extends circumferentially, or laterally, beyond the side 153C of the lug 151. In damper 72, there is an opposed lug 158 having a circumferentially extending foot 160 which also extends circumferentially, or laterally, beyond the side 153D.

As can also be seen, the damper 72 has shoulders 170A and 170D on one side of the axial reaction surface 172, and shoulders 170B and 170C on the other.

The damper could be described as having a damper body 72 extending along an axial dimension from an axial first end 301A to an opposing axial second end 301B, and between a first lateral side 302, and an opposing second lateral side 303. The damper body 72 has four lugs, including a first pair of lugs 151, 154 disposed at the first axial end and a second pair lugs 156, 158 disposed at the second axial end. A first lug in each lug pair is on the first lateral side of the damper and a second lug in each lug pair is on the second lateral side of the damper. In the first lug pair, the first lug 154 extends to an axially outermost point, which is not laterally beyond a lateral side wall 153A of the first lug 154. The second lug 151 has an axially outermost foot 152, which extends laterally beyond a lateral wall 153C of the second lug 151.

The second lug pair has a second lug 156 with an axial outermost point which does not extend laterally beyond a lateral side wall 153B. The first lug 158 has an axial outermost point with a foot 160 extending laterally beyond a lateral wall 153D. The foot 152 on the first axial end 301A of the damper is on the second lateral side 303, and the foot 160 on the second axial end 301B is on the first lateral side 302.

The damper is generally a mirror image such that it can be installed on a seal in either of two orientations, and there will still be a foot 152/160 facing an intended pocket on a gas turbine engine blade which is to receive said damper. In essence, the damper 72 is mirrored such that even if installed 180° from a desired position, there will still be a circumferentially outwardly extending foot 152, or 160, in the desired position. As noted above, the unused mirrored foot creates no concern, as it merely sits in empty space.

Returning to FIG. 4B and FIG. 5B, one can see there will also be shoulders 170B and 170C atop the posts 174 or 74. However, even if the damper is installed 180 degrees from the desired position, the other shoulders 170A and 170D will be in the proper position to provide a radial reaction surface.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A damper for use with a turbine seal comprising:

a damper body extending along an axial dimension, the damper body having an axial first end, an opposing axial second end, a first lateral side, and an opposing second lateral side;

the damper body having four lugs, including a first pair of lugs disposed at the first axial end and a second pair lugs disposed at the second axial end, wherein:

a first lug in each said lug pair is on the first lateral side of the damper and a second lug in each lug pair is on the second lateral side of the damper;

in said first lug pair, the first lug extending to an axially outermost point, which is not laterally beyond a lateral side wall of said first lug, the second lug having an axially outermost foot which extends laterally beyond a lateral wall of said second lug; and in said second lug pair, the second lug has an axial outermost point which does not extend laterally beyond a lateral side wall of said second lug, the first lug having an axial outermost point with a foot extending laterally beyond a lateral wall of said first lug, and said foot on said first axial end of said damper being on the first lateral side, and said foot on said second axial end being on the second lateral side.

2. The damper as set forth in claim 1, wherein said damper body can be installed on a seal in either of two orientations, and there will still be a foot facing an intended pocket on a gas turbine engine blade which is to receive said damper.

3. The damper as set forth in claim 1, wherein said damper body also has a pair of radial reaction shoulders on said first lateral side, and a pair of radial reaction shoulders on said second lateral side.

4. A turbine assembly comprising:

a plurality of circumferentially spaced turbine blades, each of said turbine blades having an airfoil extending radially outwardly of a platform, with said airfoils defining a leading edge and extending to a trailing edge, with said trailing edge being generally spaced axially from said leading edge, and there being a suction side and a pressure side for each said platform on each of said blades, with a seal and damper assembly positioned circumferentially intermediate a suction side of a first of said blades, and a pressure side of a second of said blades, with said seal being received within shoulders on a body of said damper;

the damper including a damper body extending along an axial dimension, the damper body having an axial first end, an opposing axial second end, a first lateral side, and an opposing second lateral side, the damper body having four lugs, including a first pair of lugs disposed at the first axial end and a second pair lugs disposed at the second axial end, wherein:

a first lug in each said lug pair is on the first lateral side of the damper and a second lug in each lug pair is on the second lateral side of the damper;

in said first lug pair, the first lug extending to an axially outermost point, which is not laterally beyond a lateral side wall of said first lug, the second lug having an axially outermost foot which extends laterally beyond a lateral wall of said second lug; and in said second lug pair, the second lug has an axial outermost point which does not extend laterally beyond a lateral side wall of said second lug, the first lug having an axial outermost point with a foot extending laterally beyond a lateral wall of said first lug, and said foot on said first axial end of said damper being on the first lateral side, and said foot on said second axial end being on the second lateral side.

5. The turbine assembly as set forth in claim 4, wherein said damper body can be installed on a seal in either of two orientations, and there will still be a foot received in a pocket on one of said first and second blades.

6. The turbine assembly as set forth in claim 5, wherein said damper body also has a pair of radial reaction shoulders on said first lateral side, and a pair of radial reaction shoulders on said second lateral side.

7. The turbine assembly as set forth in claim 6, wherein both of said first and second blades having a pocket adjacent the leading edge, and a post spaced toward said trailing edge from said leading edge on both of said suction and pressure sides, and one of said first and second feet being received in said pocket of one of said first and second blades, with the other of said first and second feet being on an opposed axial side of one of said posts relative to said one of said feet.

8. The turbine assembly as set forth in claim 7, wherein one of said radial reaction shoulders on each of said first and second lateral sides being positioned radially outwardly of one of said posts on each of said first and second blades, and the other of said radial reaction shoulders on each of said first and second lateral sides being spaced axially from said post.

* * * * *